United States Patent [19]

Machacek

[11] 3,985,593

[45] Oct. 12, 1976

[54] WATER GEL EXPLOSIVES

[75] Inventor: Oldrich Machacek, Allentown, Pa.

[73] Assignee: Atlas Powder Company, Dallas, Tex.

[22] Filed: July 28, 1975

[21] Appl. No.: 599,932

[52] U.S. Cl. ..... 149/62; 149/78; 149/89

[51] Int. Cl.[2] ..... C06B 31/12; C06B 29/16; C06B 25/36

[58] Field of Search ..... 149/62, 78, 89, 91, 149/108.8

[56] References Cited

UNITED STATES PATENTS

| | | | |
|---|---|---|---|
| 3,282,753 | 11/1966 | Cook | 149/46 |
| 3,356,544 | 12/1967 | Fee | 149/89 |
| 3,390,029 | 6/1968 | Preckel | 149/44 |
| 3,409,485 | 11/1968 | Minnick | 149/21 |
| 3,419,444 | 12/1968 | Minnick | 149/2 |
| 3,653,996 | 4/1972 | Edwards | 149/89 |
| 3,695,947 | 10/1972 | Edwards | 149/89 |
| 3,765,966 | 10/1973 | Edwards | 149/89 |
| 3,765,967 | 10/1973 | Funk | 149/21 |

*Primary Examiner*—Samuel W. Engle
*Assistant Examiner*—Donald P. Walsh

[57] ABSTRACT

A method for producing water gel explosives by solubilizing a nitroparaffin sensitizer having 1–3 carbon atoms, preferably nitromethane, in an aqueous oxidizer perchlorate salt solution by incorporating in the composition a nitroparaffin solubilizing agent, such as ethylene glycol, and the product so produced.

34 Claims, No Drawings

WATER GEL EXPLOSIVES

BACKGROUND OF THE INVENTION

Nitroparaffins having 1–3 carbon atoms and mixtures thereof, and particularly nitromethane, are known to be sensitizers for water gel explosives but some serious problems are encountered in producing separation stable water gel explosives using nitroparaffin sensitizers. Nitromethane is soluble to a certain degree, say 10 to 15%, in an aqueous phase. However, this concentration is seldom sufficient to achieve the desired sensitivity especially for cap sensitive compositions. Higher concentrations of nitromethane can be used to more effectively sensitize water gel explosive compositions. To achieve the higher concentrations or a more sensitive condition, the insoluble portion of the nitromethane must either be solubilized in the aqueous phase or suspended or dispersed therein by mixing it as very fine droplets in the overall aqueous gel structure of the explosive composition. When dispersing or suspending the nitromethane it is usually accepted that the finer the droplets, the higher will be the sensitivity factor.

In the case of the more fluid pourable and pumpable gels, the fine droplets of nitromethane have a tendency to coalesce into larger less effective droplets and to migrate until the insoluble nitromethane has effectively separated from the aqueous gel structure to form a separate layer. When this occurs, the overall composition becomes less sensitive and in most cases undetonable. This type of product is most unacceptable especially when the nitromethane sensitized explosive gel is poured or pumped through water which may cause the nitromethane to be separated from the aqueous gel structure more rapidly. Water attack on the aqueous gel structure accelerates this separation. Even stiff nonpourable or nonpumpable nitromethane sensitized gels show a tendency for the nitromethane to separate during storage.

In prior attempts to stabilize the nitromethane so that it resists coalescence and separation, various approaches have been taken. For instance, emulsifiers have been used for stabilizing the nitromethane, but the presence thereof appears to reduce the overall water resistance of such a composition. In storage, the separation shelf life of the emulsion-gel is directly related to the quality of the aqueous gel produced by the guar gelling agent, to the quality of the nitromethane emulsion as it is effected by the quality of the emulsifying agent, the size of the nitromethane dispersion and the mixing procedure.

Others have suggested the use of nitrocellulose as a gelling agent for the nitromethane but have failed to produce cap sensitive or higher sensitive compositions which indicates that high nitromethane concentrations or adequate dispersions were not even contemplated. In addition, a slower two-step process is taught for producing the composition wherein the nitroparaffin is first gelled after which it is combined by mixing with an aqueous oxidizer phase (Minnick U.S. Pat. No. 3,419,444). This necessarily means that the nitromethane gel will be dispersed in a variety of particle sizes throughout the aqueous phase rather than in the more desirable smaller droplets.

My copending patent application Ser. No. 593,307 filed July 7, 1975 teaches the simultaneous in situ gelation of the nitroparaffin and aqueous phases through the use of a gelling agent for the nitromethane and another gelling agent for the aqueous phase.

With regard to solubilizing the nitromethane, a nitromethane compound such as Tris (hydroxymethyl) nitromethane is used which is soluble in the aqueous phase of the composition or an alcohol is added to aid in making the nitroparaffin more soluble in aqueous gels (Minnick U.S. Pat. No. 3,419,444 and U.S. Pat. No. 3,409,485). However, once again booster systems are required to detonate these compositions and higher nitromethane concentrations are not contemplated. In addition, the U.S. Pat. No. 3,409,485 patent does not suggest the use of perchlorates and only a portion of the nitromethane in the composition is solubilized.

U.S. Pat. No. 3,765,967 discloses a water gel explosive composition wherein an alkali or alkaline earth metal perchlorate, e.g. sodium perchlorate, is used along with ethylene glycol, as an organic liquid fuel. There is no disclosure of the use of a nitroparaffin, particularly nitromethane, and if high sensitivity is desired other fuels such as particulate aluminum or explosives such as TNT, PETN or RDX are added.

THE INVENTION

The invention involves a new and novel method of solubilizing small to large amounts of insoluble nitroparaffin in aqueous gel explosive systems to produce both high and low sensitive compositions which can be initiated without resorting to the use of large boosters. The nitroparaffin is completely solubilized in an alkali metal or alkaline earth metal perchlorate solution, e.g. sodium perchlorate solution, by incorporating a solubilizing agent, such as diols, triols, or methyl, ethyl and propyl alcohols. Ethylene glycol has been found to be particularly effective as a nitroparaffin solubilizing agent. If 30% of nitromethane is used based upon a solution of nitromethane, water and perchlorate, then about half of that amount of ethylene glycol is added to the solution. On the other hand, if 20% nitromethane is used then about one fifth of that amount of ethylene glycol is added. Diethylene glycol is also an effective solubilizer.

Nitromethane is more soluble in a perchlorate solution than in water or an ammonium nitrate solution, however, this degree of solubility still does not provide for the desired increase in sensitivity. The solubility of nitromethane in a sodium perchlorate-water-ethylene glycol mixture far exceeds the solubility of nitromethane in sodium perchlorate-water or ammonium nitrate-water solutions.

With the present invention, complete solubilization of nitromethane in sodium perchlorate-ethylene glycol solution does not require an emulsifying agent or gelling agents for the nitromethane in order to achieve good dispersion of the nitromethane in the oxidizer solution. Therefore, the nitromethane will not separate even after prolonged storing. High energy formulas can be prepared which have sufficient sensitivity even at low temperatures. The sensitivity can be further increased by adding finely divided aluminum or by incorporating small voids such as gas bubbles, glass or plastic spheres.

Sodium perchlorate can be used as the oxidizing salt by itself or it can be used as the primary salt with up to 30% of sodium nitrate, calcium nitrate or sodium chlorate or mixtures thereof added.

Based upon the total weight of the composition, the composition of the present invention is preferably formed of 40–90% sodium perchlorate oxidizer aqueous salt solution of 50–80% concentration, 5–50% nitroparaffin and 1–30% of nitroparaffin solubilizing diols, triols or methyl, ethyl or propyl alcohols. Fuels such as particulate aluminum up to the 20% level can be added to the composition for higher sensitivity or increased power output. A gelling agent for the aqueous solution such as guar gum is present in the amount of 0.1–3%. A crosslinking agent in the amount of .02–.3% is incorporated based upon the weight of the gelling agent. Voids may be incorporated to increase the sensitivity for instance, air bubbles or hollow microspheres can be incorporated in the composition.

To adjust the oxygen balance of the gels, liquid or solid fuels commonly used in the explosive art may be added with water soluble liquid fuels being preferred.

For gelling the aqueous solution the more conventional water soluble gums and gel modifiers such as guar and preferably chemically modified guars, can be used satisfactorily. Other examples of gelling agents and gel modifiers for the aqueous phase are carboxymethyl cellulose, methyl cellulose, water soluble starches, pregallatinized starch, cereal flour, plant gums, karaya, synthetic polymers including polyacrylamides and polyvinyl alcohols and the like.

Alternatively, the sensitivity can also be enhanced by adding chemical gas release agents during the mixing.

Suitable crosslinking agents for the gelling agents are polyvalent metal salts, borates, chromates, dichromates, antimonates and oxalates and tartarates. Potassium dichromate and "potassium pyroantimonate" are good crosslinkers.

DETAILS OF THE INVENTION

The following examples serve to illustrate the invention.

EXAMPLE 1

A basic explosive nitromethane solution was prepared by mixing 67 parts of sodium perchlorate water solution of 65–75% concentration, 12 parts of ethylene glycol and 20 parts of nitromethane. This solution is not cap sensitive but it is fully detonable under heavy confinement. The sensitivity was increased by incorporating 1 part of fine hollow glass microspheres. Guar gum as the gelling agent was added in the amount of 1 part and 0.03 parts of potassium pyroantimonate as the crosslinking agent was incorporated. This composition was detonated with a No. 6 cap.

EXAMPLE 2

An explosive composition is formed of 64 parts of sodium perchlorate solution (65–75% concentration), 20 parts of nitromethane, 12 parts of ethylene glycol, 2 parts of paint grade aluminum, 1 part of glass microspheres, 1 part of guar gum as the gelling agent and 0.03 parts of potassium pyroantimonate as the crosslinking agent. This gel had a density of 1.34g/cc and was sensitive to a No. 6 cap and 40 grain detonating cord at 0° F. The composition detonated at 17,400 ft/sec. in a 2 inch diameter cartridge.

On the other hand, it is not sensitive in the rifle bullet test when hit by a 30:06 150 grain copper jacket, lead nosed bullet at 100 ft. distance using a ½ inch steel backing plate.

As will be evident to those skilled in the art, various modifications can be made or followed in light of the foregoing disclosure and discussion, without departing from the spirit or scope of the claims.

What is claimed is:

1. A method for producing a single phase water gel explosive composition in which a liquid paraffin sensitizer having 1–3 carbon atoms is completely solubilized consisting of the steps of mixing 40–90% of an aqueous perchlorate oxidizer solution having a concentration of 50–80% and selected from the group consisting of alkali metal and alkaline earth metal perchlorates with 5–50% of a liquid nitroparaffin having 1–3 carbon atoms, an amount in excess of that which can be solubilized in the perchlorate oxidizer solution, to substantially solubilize the nitroparaffin therein, completing the solubilization of the nitroparaffin by adding to the mixture 1–30% of a further solubilizing agent for the nitroparaffin selected from the group consisting of diols, triols, methyl, ethyl and propyl alcohols, adding to the mixture 0–20% of a particulate aluminum, 0–5% void space forming material, 0–1.3% of a gelling agent and 0.02–0.03% of a crosslinking agent, said percent values being based upon the total weight of the composition.

2. The method of claim 1 wherein the perchlorate solution is formed of sodium perchlorate.

3. The method of claim 1 wherein the solubilizing agent is a diol.

4. The method of claim 3 wherein the diol is ethylene glycol.

5. The method of claim 1 wherein the nitroparaffin is nitromethane.

6. The method of claim 2 wherein the sodium perchlorate solution contains up to 30% of a member selected from the group consisting of sodium nitrate, calcium nitrate and sodium chlorate.

7. The method of claim 1 wherein voids are formed in the mixture.

8. The method of claim 7 wherein said voids are formed by a member selected from the group consisting of gas, hollow glass spheres, resin balloons, wood pulp and perlite.

9. The method of claim 1 wherein fuels are added to the mixture.

10. The method of claim 9 wherein particulate aluminum is added to the mixture.

11. The method of claim 1 wherein the gelling agent is a member selected from the group consisting of carboxymethyl cellulose, methyl cellulose, water soluble starches, pregellatinized starch, cereal flour, plant gums, karaya, synthetic polymers, polyacrylamides and polyvinyl alcohols.

12. The method of claim 11 wherein the gelling agent is guar gum.

13. The method of claim 12 wherein the gelling agent is chemically modified guar.

14. The method of claim 1 wherein a polyvalent metal salt crosslinking agent is added to the mixture.

15. The method of claim 1 wherein said crosslinking agent is selected from the group consisting of metal salts of borates, chromates, dichromates, antimonates, tartarates and oxalates.

16. The method of claim 1 wherein a crosslinking agent selected from the group consisting of ammonium chromate and ammonium dichromate is added to the mixture.

17. The method of claim 1 wherein the crosslinking agent is potassium pyroantimonate.

18. A water gel single phase explosive composition in which a liquid paraffin sensitizer having 1–3 carbon atoms is completely solubilized consisting of 40–90% of an aqueous perchlorate oxidizer solution having a concentration of 50–80% selected from the group consisting of alkali metal and alkaline earth metal perchlorates, 1–30% of a solubilizing agent for a liquid nitroparaffin having 1–3 carbon atoms selected from the group consisting of diols, triols, methyl, ethyl and propyl alcohols, 5–50% of a completely solubilized liquid nitroparaffin having 1–3 carbon atoms, 0–20% of a particulate aluminum, 0–5% void space forming material, 0.1–3% of a gellng agent and 0.02–0.3% of a crosslinking agent, the percent value based upon the total weight of the composition.

19. The composition of claim 18 wherein the perchlorate solution is formed of sodium perchlorate.

20. The composition of claim 18 wherein the solubilizing agent is a diol.

21. The composition of claim 20 wherein the diol is ethylene glycol.

22. The composition of claim 18 wherein the nitroparaffin is nitromethane.

23. The composition of claim 19 wherein the sodium perchlorate solution contains up to 30% of a member selected from the group consisting of sodium nitrate, calcium nitrate and sodium chlorate.

24. The composition of claim 18 with voids therein.

25. The composition of claim 24 wherein said voids are a member selected from the group consisting of gas bubbles, hollow glass spheres, resin balloons, wood pulp and perlite.

26. The composition of claim 18 with fuels therein.

27. The composition of claim 26 wherein the fuel is particulate aluminum.

28. The composition of claim 18 wherein the gelling agent is a member selected from the group consisting of carboxymethyl cellulose, methyl cellulose, water soluble starches, pregellatinized starch, cereal flour, plant gums, karaya, synthetic polymers, polyacrylamides and polyvinyl alcohols.

29. The composition of claim 28 wherein the gelling agent is a guar gum.

30. The composition of claim 29 wherein the gelling agent is chemically modified guar.

31. The composition of claim 18 having a polyvalent metal salt crosslinking agent therein.

32. The composition of claim 18 wherein the crosslinking agent is selected from the group consisting of metal salts of borates, chromates, dichromates, antimonates, tartarates and oxalates.

33. The composition of claim 18 having a crosslinking agent selected from the group consisting of ammonium chromate and ammonium dichromate therein.

34. The composition of claim 32 wherein the crosslinking agent is potassium pyroantimonate.

* * * * *

UNITED STATES PATENT AND TRADEMARK OFFICE

CERTIFICATE OF CORRECTION

PATENT NO. : 3,985,593

DATED : October 12, 1976

INVENTOR(S) : Oldrich Machacek

It is certified that error appears in the above-identified patent and that said Letters Patent are hereby corrected as shown below:

Column 4, line 20, "0-1.3" should be -- 0.1-3 --.

Signed and Sealed this

Eighth Day of February 1977

[SEAL]

*Attest:*

RUTH C. MASON
*Attesting Officer*

C. MARSHALL DANN
*Commissioner of Patents and Trademarks*